United States Patent [19]

Culver

[11] Patent Number: 4,629,264

[45] Date of Patent: Dec. 16, 1986

[54] VANITY CABINET AND PANEL ASSEMBLY THEREFOR

[76] Inventor: Gary A. Culver, 2645 Oak Ridge Trail, Grand Rapids, Mich. 49505

[21] Appl. No.: 678,339

[22] Filed: Dec. 5, 1984

[51] Int. Cl.[4] ..... A47B 81/00

[52] U.S. Cl. ..... 312/223; 312/227; 362/129; 362/137

[58] Field of Search ..... 312/227, 226, 224, 223, 312/276; 132/79 G, 80 A, 83 E, 83 F, 83 R; 362/133, 136, 137, 129; 190/5, 11, 16

[56] References Cited

U.S. PATENT DOCUMENTS

| | | | |
|---|---|---|---|
| 91,409 | 6/1869 | Beames | 312/227 |
| 369,000 | 8/1887 | Eubank | 312/276 |
| 1,062,962 | 5/1913 | Gaal | 312/227 |
| 1,443,858 | 1/1923 | Windecker | 312/226 |
| 1,497,379 | 6/1924 | Morse | 312/227 |
| 1,667,564 | 4/1928 | Pearson | 312/227 |
| 2,456,415 | 12/1948 | Hillenbrand | 311/38 |
| 2,758,900 | 8/1956 | Marchand | 312/227 |
| 2,863,709 | 12/1958 | Hausman | 312/321 |
| 3,381,120 | 4/1968 | Fleisher | 362/136 |

FOREIGN PATENT DOCUMENTS 2452124 5/1976 Fed. Rep. of Germany ..... 312/227

OTHER PUBLICATIONS

Article entitled "Foldaway Vanity", 1980.

*Primary Examiner*—William E. Lyddane
*Assistant Examiner*—Gerald A. Anderson
*Attorney, Agent, or Firm*—Price, Heneveld, Huizenga & Cooper

[57] ABSTRACT

A vanity cabinet is disclosed for installation as a component of prebuilt and site-assembled cabinetry, and countertop or custom built cabinets fabricated entirely on the job site. The cabinet includes a hinged cover, a folding vanity panel hinged to the underside of said cover, and a mirror and mirror support hinged to the vanity panel. The mirror and mirror support are retained for viewing in a selected, generally constant angular position with respect to the vanity panel regardless of whether the cover is raised or lowered. The vanity panel is supported by bearing assemblies such as rollers which allow that panel to automatically unfold and swing to an upright viewing position when the cover is raised. Light panels adjacent the mirror are provided for illumination.

22 Claims, 9 Drawing Figures

VANITY CABINET AND PANEL ASSEMBLY THEREFOR

BACKGROUND OF THE INVENTION

This invention relates to cabinet structures and, more particularly, to a vanity cabinet incorporating a folding mirror panel which, in the preferred embodiment, may be associated with lights for illumination.

Various types of vanity cabinet structures have been used over the years. Many have included folding tops or covers which may be raised to reveal a mirror positioned for viewing when a person is positioned in front of the cabinet. Prior known vanity cabinet structures have, however, suffered from numerous deficiencies making them undesirable from various standpoints.

For instance, toilet cabinets are shown in Gaal U.S. Pat. No. 1,062,962 and Windecker U.S. Pat. No. 1,443,858 in which pivotable top covers are raised to expose mirrors for viewing. In Gaal U.S. Pat. No. 1,062,962, a pivoted mirror is hinged to the rear of a slide-out drawer. The drawer must be pulled out to its full extent before the mirror is properly positioned for viewing. In Windecker U.S. Pat. No. 1,443,858, on the other hand, a mirror is combined with a storage cabinet such that, when a tilted receptacle is swung outwardly toward the front of the cabinet, a pair of pivoted links are moved upwardly and outwardly to both raise a top cover and swing a hinged mirror outwardly to a viewing position at the top of the cabinet. In both Gaal and Windecker, however, use of the mirror for viewing is severely limited, especially for close-up viewing, since the sliding drawers or pivoted storage areas prevent close approach to the viewing surface. Moreover, it would be virtually impossible to remain seated within front of one of these structures when the drawer or pivoted storage cabinet is operated.

Other vanity cabinets as shown in Morse U.S. Pat. No. 1,497,379 and Pearson U.S. Pat. No. 1,667,564 have been proposed for use as either freestanding or separate storage structures. In Morse U.S. Pat. No. 1,497,379, for instance, a manually pivotable cover on a freestanding combination table may be raised to a rearwardly slanted position after which a separate hinged mirror panel may be pivoted upwardly to rest against the cover panel and hold the cover in its raised position.

In Pearson U.S. Pat. No. 1,667,564, a cover is provided on a box structure which includes a slide-out drawer. The cover may be opened for use as a storage structure and includes a hinged panel having a mirror thereon. The mirror may be manually pivoted to a generally upright position to support the box-like cover.

Once again, use of the Pearson structure from close in front is difficult when the drawer structure is slid outwardly. Also, the mirror itself must be repositioned each time the box-like cover is raised in order to provide a proper viewing angle for the mirror. In Morse, the mirror panel may be supported in only two positions and is located near the rear of the cabinet making close-up viewing difficult because of the protrusion of the front of the cabinet. Moreover, with both of the Pearson and Morse structures, use of the cabinet is cumbersome because multiple operations to properly position the mirror are required. In addition, neither mirror is automatically positioned as desired.

Other variations of vanity cabinets are shown in Marchand U.S. Pat. No. 2,758,900 and Hausman U.S. Pat. No. 2,863,709. The Marchand cabinet is a complex structure using pressurized cylinders and a heavy bracket assembly to pivot a cover having a mirror mounted on its underside to a raised position. Not only is the Marchand structure expensive, but is quite complex and requires the cylinders for efficient operation.

In Hausman U.S. Pat. No. 2,863,709, a simple hinged cover with a mirror panel thereon is combined with a bathroom table and hamper structure. The cover may be supported in only one raised position, again at the back of the cabinet making close-up viewing difficult. Also, with both of the Marchand and Hausman structures, the mirror panel is not adjustable to different positions making use by persons of varying height quite difficult. Flexibility of use of all of the above structures is limited as well because none of these prior structures are designed for ease of insertion as prebuilt units in modern, prebuilt cabinets wherein on-site assembly is made by securing together the prebuilt units followed by covering with a continuous, one-piece countertop. Moreover, the prior known cabinets were also not adapted for easy insertion in custom, site-built cabinetry.

SUMMARY OF THE INVENTION

The present invention is designed to overcome the problems with prior known vanity cabinets such as those noted above. This invention includes a vanity cabinet providing for automatic unfolding and positioning of a mirror when a pivoted cover is raised. The mirror is designed for retention in a preselected, generally constant viewing position which remains essentially unchanged regardless of whether the cover is raised or lowered. Adjustment of the mirror for repeated viewing use by the same person is, therefor, generally unnecessary. However, the invention does allow mirror adjustment to accommodate different sized persons and/or different chair heights.

The present invention also provides thorough, high-quality lighting via light panels adjacent the mirror. The lights may be controlled by a switch structure connected to an electrical source by wiring which is hidden from view from the front of the cabinet. Provision for storage of toilet and other articles adjacent the folding mirror is included, while the entire vanity cabinet is designed for ease in operation and incorporation in existing or new prebuilt or site-built, built-in cabinets as well as being adaptable for use as a freestanding unit.

In a preferred embodiment of the invention, the vanity cabinet includes a bottom panel, an upstanding rear panel on the bottom panel and a cover panel having undersurface, front and rear portions. The cover panel is pivotally mounted to the rear panel for movement between a raised and lowered positions in overlying relationship to the bottom panel. Further, a mirror is mounted on a vanity panel. A first positioning structure is included for automatically pivoting the vanity panel and mirror with respect to the cover panel from a folded, substantially horizontal, lowered position to an upright position in which the mirror may be used for viewing when the cover panel is lifted. Also included is a second positioning structure for selectively positioning the mirror at a predetermined angular position with respect to the vanity panel. The angular position of the mirror remains generally constant unless purposely reset regardless of whether the cover is raised or lowered.

In another form of the invention, the mirror is pivotally mounted on the undersurface of the cover panel adjacent the front of the cover panel. Bearing assemblies are provided on the mirror mounting structure for movably supporting the mirror mounting structure on and along the bottom panel. Thus, when the cover panel is pivoted upwardly, the mirror mounting structure will automatically pivot downwardly and outwardly away from the cover panel on the bearing assemblies to position the mirror for viewing.

In yet another aspect of the invention, a panel assembly for a vanity cabinet is provided including a generally planar vanity panel adapted to be pivotally secured to the underside of a pivotable cover, a mirror support panel, a hinge for pivotally securing the mirror support panel to the vanity panel, and a mirror secured to the mirror support panel. Adjustable structure is provided for selectively positioning the mirror support panel at a predetermined angular position with respect to the vanity panel. In addition, a movable support is provided on the vanity panel for movably supporting the vanity panel over and along an underlying panel to allow automatic movement of the vanity panel to an upright position for viewing of the mirror when the vanity panel is pivotally secured beneath a pivotable cover.

In more specific aspects of the invention, an adjustable bracket is secured between the mirror panel and vanity panel provide for selective positioning of the mirror regardless of the raised or lowered position of the cover panel. Lighting panels may also be provided extending generally vertically alongside the mirror panel in other embodiments of the invention. Further, storage areas may be provided adjacent the folding mirror structure within the cabinet. Also, a front panel which supports the cover panel when in lowered position may be provided with a decorative front to match adjoining cabinetry decor.

As will be understood, the present invention provides significant advantages over prior known vanity cabinets. First, the invention provides automatically correct positioning of the mirror upon opening. The angular viewing position of the mirror may be present and remains essentially unchanged even when the cabinet is closed. This avoids any need for readjustment each time the cabinet is opened should the same person desire to use it. However, persons of different size will find the cabinet easily and quickly adjustable to their particular viewing position. A person can sit close to the front of the cabinet immediately adjacent the mirror panel which is supported immediately adjacent the front of the cabinet in viewing position.

In addition, the mechanism for unfolding the mirror when the cover is raised is safe, sure, reliable and uncomplicated thereby assuring ease of operation by anyone. Moreover, the invention provides thorough lighting regardless of the position of the cabinet within a room or the strength of the surrounding ambient lighting in a room. Also, while providing space for additional storage within the cabinet, the invention fits unobtrusively within premanufactured or site-built cabinets or countertops, or may be separately supported as a table or desk to provide an aesthetically pleasing addition to any room.

When the separate panel assembly of the present invention is provided, various other countertops and cabinets can be converted to vanity cabinets by attaching the panel assembly beneath a pivotable cover and over an underlying panel such that operation will occur as described herein.

These and other objects, advantages, purposes and features of the invention will become more apparent from a study of the following description taken in conjunction with the drawings.

DESCRIPTION OF THE PREFERRED EMBODIMENTS

Figure 1:
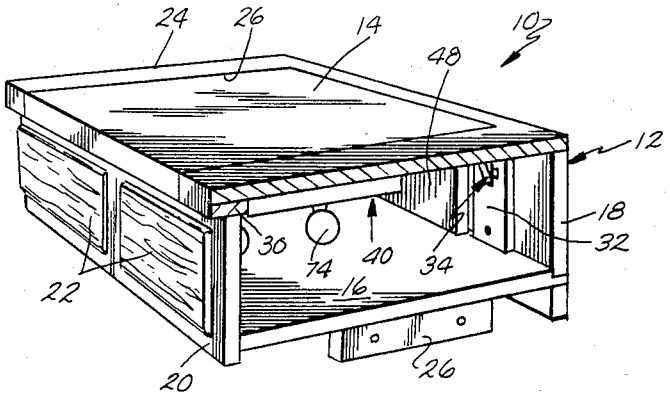
FIG. 1 is a perspective view of the vanity cabinet of the present invention shown in closed position as installed in a built-in countertop and showing a decorative front panel.
Figure 9:
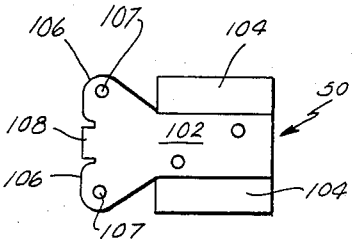
FIG. 9 a plan view of the stamping for the roller bracket of the invention shown prior to bending to its ultimate form.
Figure 2:
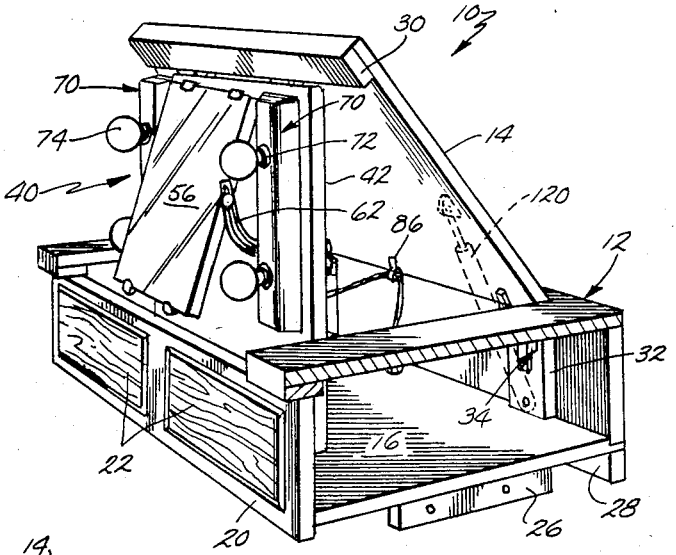
FIG. 2 is a perspective view of the vanity cabinet of FIG. 1 but shown with the cover in raised position and the mirror panel assembly in unfolded, viewing position.
Figure 4:
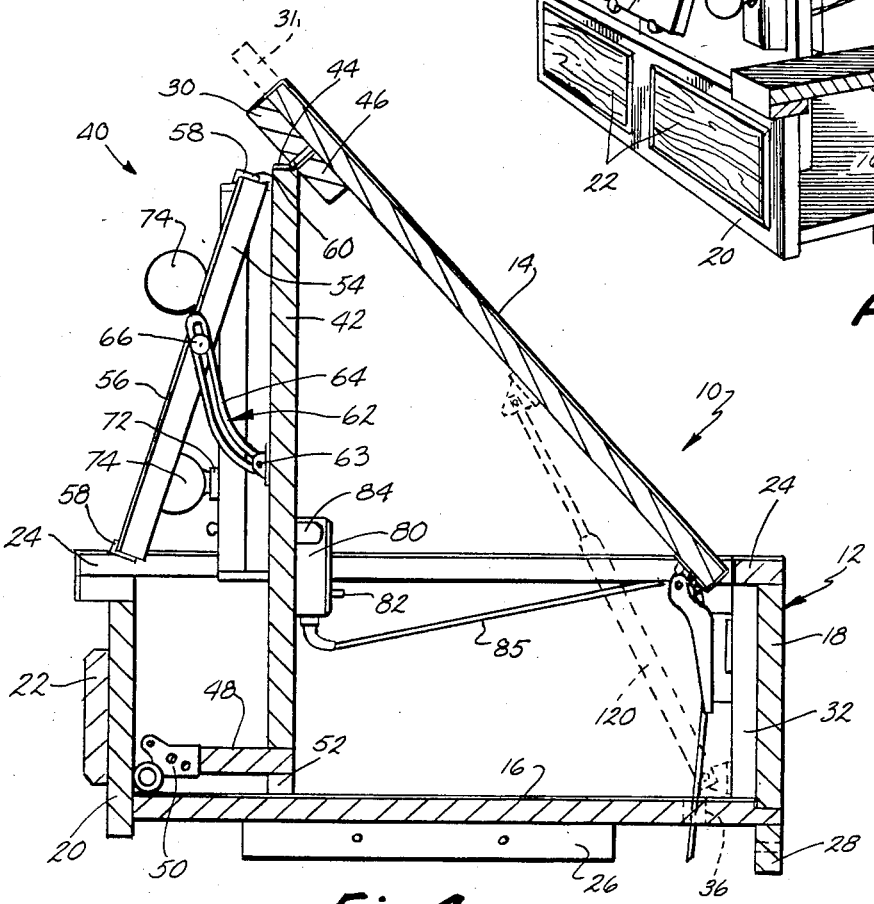
FIG. 4 is a sectional, side elevation of the vanity cabinet taken along plane IV—IV of FIG. 3.
Figure 3:
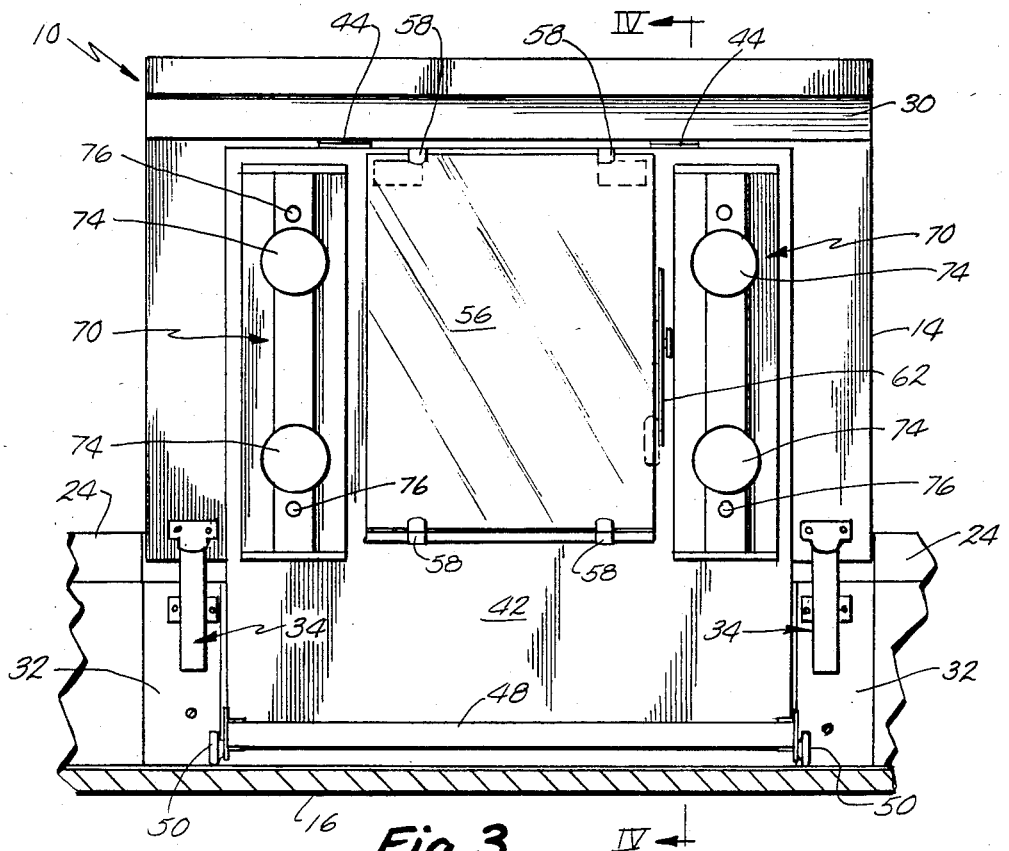
FIG. 3 is a sectional, front elevation of the vanity cabinet of FIG. 2 with the cover panel raised and mirror panel assembly unfolded for viewing.

Referring now to the drawings in greater detail, FIGS. 1–7 illustrate a first embodiment 10 of the vanity cabinet of the present invention designed for use either in a continuous countertop structure or as a freestanding unit supported on separate side panels or the like. FIGS. 1–7 show the invention broken out of a built-in cabinet with continuous countertop applied. The vanity cabinet includes two major portions including a cabinet assembly 12 and a mirror panel assembly 40. Cabinet 12 has a rectangular, generally planar, pivotable cover panel 14 beneath which panel assembly 40 is pivotally secured for automatic unfolding. Panel assembly 40 swings outwardly into position adjacent to the front of the cabinet 12 to a11ow viewing in the mirror when cover panel 14 is raised as shown in FIGS. 2–4.

Figure 5:
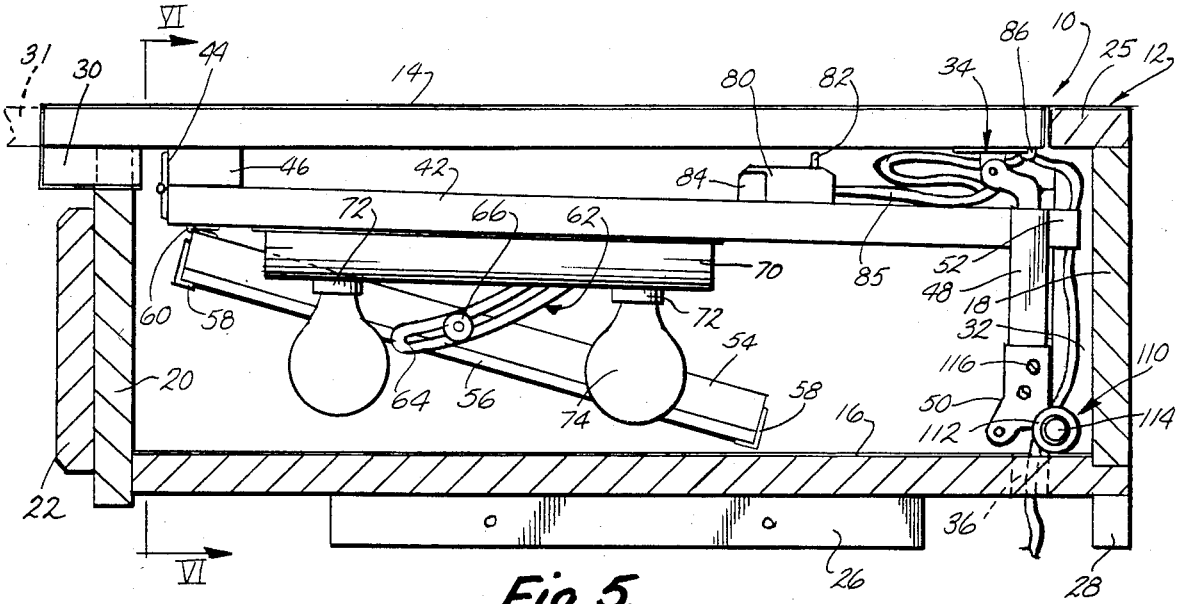
FIG. 5 is a sectional, side elevation of the vanity cabinet with the cover closed and mirror panel assembly in folded position.

As is best seen in FIGS. 1, 2 and 4–6, cabinet assembly 12 includes a rectangular bottom panel 16, a vertical or upstanding, rectangular rear panel 18, a vertical or upstanding, rectangular front panel 20 which may include decorative panel portions 22 thereon, as well as a top panel 24 (FIGS. 1 and 2). Front and rear panels 18, 20 are generally longer than they are high such that the overall cabinet is longer and wider than its height. Top panel 24 is formed by a rear strip member 25 and countertop pieces 24 which abut the side edges of strip member 25 as applied in the field upon installation. A continuous laminated plastic sheet or other covering is then applied over member 25 and pieces 24 to hide the joints between these pieces. The top panel includes a rectangular opening 26 therein for receipt of cover 14. Each of panels 14–25 is generally planar and may be formed from wood or particle board covered with a plastic laminate sheeting, a synthetic countertop material, a wood veneer, or other finishes as desired. As shown in FIGS. 4 and 5, however, the preferred embodiment 10 of the invention is shown incorporating particle board or wood covered with a plastic laminate sheeting or veneer.

Figure 6:
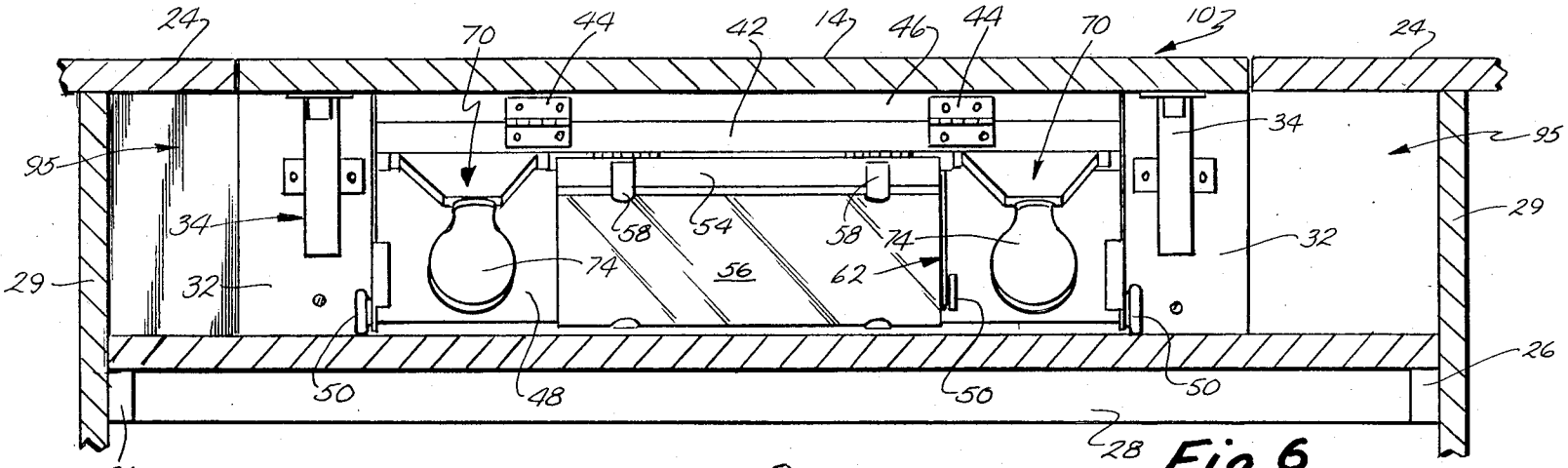
FIG. 6 is a sectional, front elevation of the vanity cabinet in closed position taken along plane VI—VI of FIG. 5.

Rear panel 18 is recessed into the top surface of bottom 16 (FIG. 5). Top panels 24 are secured to the upper, parallel edges of front and rear panels 18, 20. Front panel 20 has a somewhat greater height than the rear panel in order to extend below the bottom panel 16. The lower extension of front panel 20 serves to substantially hide from view wooden or other securing strips 26, 28 from the front. Strips 26, 28 are secured to the bottom surface of bottom panel 16 at the sides and rear and allow insertion of screws or other fasteners therethrough to attach the cabinet 10 between adjacent lavatory, desk or built-in cabinets or separate side panels. As shown in FIG. 6, a preferred method for securing cabinet assembly 10 is through the use of screws extending through strips 26 and into vertically extending side panels 29 already existing in the cabinet structure.

As will also be seen from FIGS. 1, 4 and 5, the upper edge of rear panel 18 is slightly higher than that of front panel 20. This allows a separate strip member 30 to be secured beneath the front of cover 14 such that a plastic laminate, veneer or the like may be applied to a double thickness of cover 14 along its front edge for aesthetic purposes to match thickness of adjoining countertop edge. Strip 30 also serves as a convenient handhold for lifting cover 14 as will be explained below. A handle (not shown), such as one which matches the other handles on the cabinet in which the vanity cabinet is installed, may be secured to the front edge of cover 14 to aid in lifting and lowering the cover.

Figure 8:
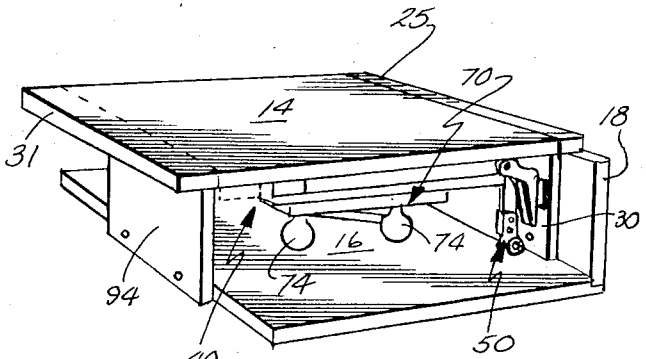
FIG. 8 is a perspective view of a modified form of the invention with side and front portions removed and ready for installation in a prebuilt or site-built cabinet and application of an appropriate countertop.

Typically, when the invention is provided as a complete vanity cabinet, cover 14 is provided longer than its final length as shown at 31 in FIGS. 4, 5 and 8. The extending portion is cut off in the field for alignment with the adjacent countertop and secured under the front edge of the cover as strip 30 after which a plastic laminate or other veneer may be applied to the front surface. Securing of the various panels in the assembly may be made by screws, nails, adhesives and the like as is conventionally known in the cabinet industry.

Cover 14 is attached to the cabinet 10 for pivotal movement between a lowered position, in which it is parallel to bottom panel 16 (FIG. 1), and a raised position in which it extends out of opening 26 at an acute angle to top 24 (FIG. 2). A preferred method for pivotally securing cover 14 to the cabinet is shown in FIGS. 1–7 and includes a pair of upstanding wooden or other blocks 32 secured by screws, adhesive or the like to the inside surface of rear panel 18 adjacent the outer portions of opening 26. Blocks 32 also help support the rear of top panel 24. On the inside surface of blocks 32 are secured a pair of furniture hinges 34 which extend into the interior of the cabinet and are attached to the undersurface of cover 14 at positions spaced from the rear edge of cover 14 as shown in FIGS. 4 and 5. A preferred furniture hinge found suitable for use in the present cabinet assembly is that sold by Julius Blum, Inc. of Stanley, N.C. 28164, and sold under Model No. 91.270 or 91.275 and known as the Blum Model 90 furniture hinge. Thus, when the front edge of cover 14 is lifted, the rear edge of the cover will pivot downwardly away from the rear strip of top panel 24 on hinges 34 as is best seen in FIG. 4. A wiring apperture 36 extends through the thickness of bottom panel 16 in order to allow wiring access to the interior of the cabinet as will be explained more fully below.

As mentioned, panel assembly 40 is designed for attachment to the undersurface of cover 14 such that the assembly operates within the interior of cabinet 12 to provide a mirror in viewing position when cover 14 is raised as shown in FIG. 2. Panel assembly 40 includes a generally planar, rectangular vanity panel or back member 42 having secured at its upper end a pair of spaced, loose pin hinges 44. Hinges 44 are attached to the front edge of a wood or other strip member 46 extending across the undersurface of cover 14 at a position spaced slightly rearwardly from front strip member 30 as shown in FIGS. 4 and 5. At the lower or opposite end of vanity panel 42 from hinges 44 is secured a generally rectangular, planar, end panel or flange 48 extending at a right angle to vanity panel 42. Panel 48 extends downwardly toward bottom panel 16 and includes an end edge adjacent which roller assemblies 50 are mounted at spaced positions at either side edge of panel 48. Together panels 42 and 48 form a generally L-shaped panel.

Preferably, as shown in FIGS. 3–8 and 9, roller assemblies or brackets 50 each include a stamped, sheet metal body 102 having side flanges 104, which are bent at right angles to body 102, and roller mounting ears or flanges 106 each having a roller mounting aperture 107 therethrough. An end flange 108 between ears 106 is bent at right angles to the plane of body 102 and flanges 104. A wheel assembly 110 having a plastic tire 112 rotatably mounted on a metallic stud 114 (FIGS. 5 and 7) with balls or other rolling members therebetween is pressed and swaged through one of the apertures 107 such that the tire projects below and beyond ear 106 to support the panel assembly 40 as shown. The formed bracket 50 is fitted over one side edge of panel 48 and secured with screws or other fasteners 116 FIG. 5 . Depending on which ear 106 wheel assembly 110 is secured to, the bracket assembly 50 may be used on either the right or left side edge of panel 48.

Alternately, it is possible to substitute tracks (not shown) mounted along bottom panel 16 parallel to the side edges of cover 14 and slides mounted at spaced positions on the end of panel 48 for sliding movement in those tracks to allow the panel assembly to slide forwardly as cover 14 is lifted. Of course, other bearing assemblies or roller assemblies sufficient to support the weight of panel assembly 40, having the required spacing and dimensions, and allowing the panel assembly to move forwardly as cover panel 14 is lifted may also be used.

On the undersurface of panel 48 in line with vanity panel 42 are also secured a pair of wooden or rubber support blocks 52 (FIGS. 4, 5 and 7) each of which has a height substantially the same as the height of the roller assemblies 50 when secured to the end panel 48. Support blocks 52 engage bottom panel 16 when vanity panel 42 is in its raised position as shown in FIG. 4 such that the entire panel assembly 40 is generally supported in a vertical position with rollers 50 engaging the inside surface of front panel 20 as shown.

Pivotally secured to the front surface immediately adjacent the top edge of the panel 42 is mirror support panel 54 having a generally planar front or rear surfaced, silvered mirror 56 mounted on its outwardly facing surface by means of clear acrylic mirror brackets 58 or the like. Mirror 56 may be planar or curved for magnification. The top edge of mirror support panel 54 is secured by means of a pair of spaced, loose pin hinges 60 to the upper front surface of vanity panel 42. Hinges 60 allow panel 54 to be pivoted from a position generally parallel to and abutting vanity panel 42 to a position at which panel 54 extends at an acute angle to panel 42 with its lower edge the greatest distance from panel 42 as shown in FIGS. 2, 4, 5 and 6. As in cabinet 12, panels 42, 48 and 54 may be formed from wood, particle board, molded plastic or the like and finished or covered as desired with veneers, plastic laminate sheets, or the like.

In order to allow panel 54 to be selectively positioned at different angular positions with respect to vanity panel 42 and held in those positions, an adjustable bracket assembly 62 is provided. Bracket assembly 62 includes a curved, slotted bracket 64 pivotally mounted at 63 to the front surface of vanity panel 42 as shown in FIG. 4. A thumbscrew or other threaded element 66 coupled with a leaf spring (not shown) to provide friction pressure is received over a threaded stud extending laterally from one side edge of mirror support panel 54 through the central slot in bracket 64. As mirror support panel 54 is pivoted outwardly away from vanity panel 42 on hinges 60, the stud slides along the slot in bracket 64 while the slotted bracket moves due to movement of the stud within the bracket. When the desired position is reached, thumbscrew 66 may be tightened sufficiently to hold mirror support panel 54 and mirror 56 in the desired angular position with respect to the vanity panel 42 yet allow adjustment against the leaf spring pressure without loosening thumbscrew 66 unless that thumbscrew is overtightened. This position remains constant regardless of whether cover 14 is raised or lowered as shown in FIGS. 2–6 except when panel 54 is pivoted outwardly to its greatest extent. When in its maximum outward position, panel 54 and mirror 56 would engage bottom panel 16 when cover 14 is closed and panel 42 is pivoted rearwardly. Thus, for tall persons who need the mirror pivoted out to its maximum position, panel 54 need only be pivoted in a slight distance before cover 14 is closed which keeps panel 54 and mirror 56 in generally the same angular position but allows closure as shown in FIG. 5. Alternately, the height or depth of panels 18, 20 and 48 may be increased to provide additional space to receive panel 54 and mirror 56 even when pivoted outwardly to its maximum extent. Of course, other adjustable mechanisms such as ratcheted brackets, spacing members or the like may be used to position mirror support panel 54 with respect to vanity panel 42 as desired. A suitable slotted, pivotal bracket assembly 62 for use in this invention may be obtained from Brainerd Manufacturing Company of East Rochester, N.Y. under Part No. 1078 or 121086.

When raised, cover 14 allows vanity panel 42 to swing and pivot outwardly on hinges 44 and rollers 50 along the top surface of bottom panel 16 until vanity panel 42 is generally vertically positioned and mirror support panel 54 and mirror 56 are angularly positioned for viewing as shown in FIG. 4. If cabinet 10 is located in a room with sufficient ambient lighting, no illumination for use of or viewing with the mirror 56 is needed. However, in other environments where ambient lighting is insufficient or greater illumination is desired, appropriate lighting panel assemblies 70 may be included in the vanity cabinet. As shown in FIGS. 2–6, panel assembly 40 may include a pair of elongated lighting panels 70, one positioned generally parallel to and adjacent either side edge of mirror support panel 54 on the front surface of vanity panel 42. Each lighting panel 70 includes a pair of incandescent light bulb receptacles 72 preferably receiving 40 watt incandescent light bulbs 74. Bulb receptacles 72 are positioned adjacent the upper and lower ends of light panels 70 such that one bulb 74 will be located on either side of the mirror adjacent the upper end of the mirror with a pair of bulbs adjacent the lower end as well. Each bulb 74 has a length sufficient to provide illumination adjacent the mirror even when the mirror is angled away from vanity panel 42 as shown in FIGS. 2, 4 and 5. Thus, bulbs 74 will extend past the surface of mirror 56 adjacent the upper end of the mirror and substantially even with the surface of the mirror at the lower end of the mirror even when the mirror support 54 is moved substantially away from vanity panel 42 with bracket assembly 62. A preferred light panel is that obtained under the trademark "LITEBAR" from Troy Lighting Inc. of City of Industry, Calif., 91746. Of course, other light assemblies could be used incorporating fluorescent or other light sources as desired. Light panels 70 are typically secured to vanity panel 42 with screws 76 (FIGS. 3 and 4) or the like.

In order to operate light panel 70, a conventional metal or other switch box 80 incorporating a normally closed momentary contact switch assembly (not shown) operated by a plunger member 82 (FIGS. 4 and 7) is secured to the rear surface of vanity panel 42. Pivoting of vanity panel 42 away from cover 14 when it is raised releases plunger 82 to close the switch and turn on the lights. Conversely, when the cover is closed, the switch is opened to deactivate the lights. Alternately, a manual switch (not shown) could be substituted on the front of panel 42.

Figure 7:
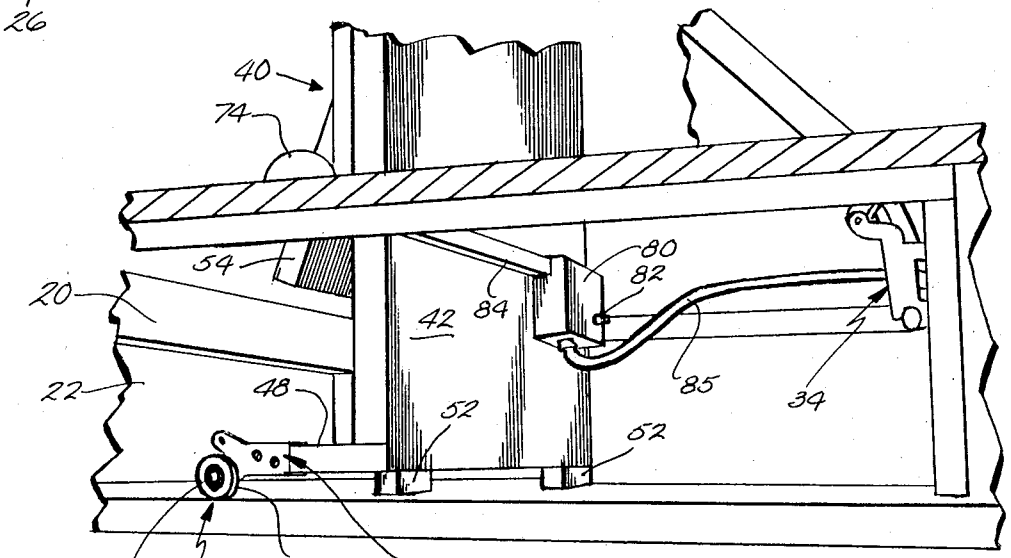
FIG. 7 is a fragmentary, perspective view of the rear surface of the vanity panel showing the electrical switch box and wiring assembly when the mirror panel assembly is unfolded and the cover panel is in its raised position.

Switch box 80 is typically aligned with the left hand light panel 70 but includes a rigid electrical conduit 84 extending across the rear surface of vanity panel 42 to a position in registry with the right hand light panel 70 for housing electrical wiring leading to the right hand assembly. Appropriate apertures (not shown) through vanity panel 42 are provided to lead wiring from the switch box 80 and conduit 84 to light assemblies 70. As shown in FIGS. 4, 5 and 7, an electrical cable 85 extends out of the bottom of switch box 80 and through a retaining clip 86 fastened to the undersurface of cover 14 adjacent its rear edge to support cable above bottom panel 16. From support clip 86, electrical cable 85 extends downwardly through aperture 36 in bottom panel 16 and out of cabinet 12 for connection to a building or other electrical system providing conventional, 110 volt alternating electric current. The cabinet has a continuous ground and is designed to be plugged into a 110 volt ground fault protected receptacle through cable 85. Cable 85 is sufficiently long between clip 86 and switch box 80 to allow vanity panel 42 to pivot to its full upright position as shown in FIG. 4. Conversely, when cover 14 is closed and vanity panel 42 returns to its folded position, cable 85 automatically bends and folds within the space between the rear of vanity panel 42 and the undersurface of cover 14 as shown in FIG. 5.

Another embodiment 90 of the vanity cabinet is shown in FIG. 8 wherein like numbers indicate like parts to those in embodiment 10. Embodiment 90 is substantially similar to vanity cabinet 10 except that it is shown to incorporation in any built-in cabinet, includes only strip member 25 at the rear of cover 14 and includes extension 31 on cover 14 prior to cutting for alignment with the adjacent cabinetry. Also, a temporary support panel 94 is screwed to the front edge of bottom panel 16 to support top panel 14 parallel to bottom panel 16 during shipment and installation of vanity cabinets 90 between factory built cabinets, custom site-built cabinets, side panels, desk units or the like. Embodiment 90 of the cabinet enables custom fitting of the invention within a countertop or cabinet. The installer need merely provide his own top panels 24 which will mate with and extend parallel to the cover panel adjacent either side and abut strip member 25. Then a decorative, front panel is substituted in place of panel 94 and cover 14 is cut to match adjacent cabinets, followed by covering panels 24 and member 25 with appropriate sheeting or veneer if desired.

Alternatively, panel assembly 40 may be separately provided such that the installer can build his own cabinet structure for receipt of the panel assembly. In such case, panel assembly 40, complete with switch box 80 and wiring 85, is ready for receipt of a pair of loose pin hinges 44 and may be secured via such hinges to the underside of a cover panel or other pivotable cover provided by the installer. Electrical cable 85 need only be clipped to the undersurface of the cover and lead downwardly through an opening in the bottom panel in the cabinet and connected to the existing electrical system of the building in which the cabinet is mounted to ready the invention for operation.

In any embodiment of the invention, it will be understood that operation begins with the vanity panel in its substantially horizontal, folded position as shown in FIG. 5. In that folded position, roller assemblies 50 extend downwardly past the end edge of end flange 48 and engage the top surface of bottom panel 16. Such position provides an interior space in which the light assemblies 70, bulbs 74, angularly positioned mirror support panel 54, and mirror 56 are easily received even when the cover 14 of vanity cabinet 10 or 90 is closed.

When movement to the operating position is desired, the front edge of cover 14 is raised to the position shown in FIGS. 2–4. The pivotal movement of cover 14 upwardly raises the front edge of vanity panel 42 by means of loose pin hinges 44 while the force of gravity continuously urges the opposite, lower end of vanity panel 42 toward the front of the cabinet. Such movement is allowed along rollers 50 until the rollers engage the inside surface of front panel 20 and support blocks 52 engage the top surface of bottom panel 16. In that position, vanity panel 42 is substantially vertical and supported against the inside surface of front panel 20 in secure position to allow viewing of the mirror which itself is separately positioned by means of bracket assembly 62 about hinges 60. The weight of cover 14 pressing downwardly on the top edge of vanity panel 42 retains blocks 52 in contact with the bottom panel and ro11er aeeemb1ies 50 in engagement with the corner between front panel 20 and bottom panel 16.

Simultaneously, when vanity panel 42 pivots away from cover 14, plunger 82 on switch housing 80 is released to automatically activate light panels 70 and bulbs 74 to provide illumination for viewing in the mirror. Should the angular position of mirror support panel 54 be incorrect for the operator, thumbscrew 66 need merely be loosened and the angular position of the mirror support panel changed followed by retightening of the thumbscrew. If the thumbscrew is not overtightened, the mirror position can be changed against the friction pressure of the leaf spring in the adjustment bracket. When closing of the cover and folding of the vanity panel is desired, mirror support panel 54 will remain in its present position while vanity panel 42 is urged backwardly and cover panel 14 is lowered until the undersurface of strip member 30 engages the top edge of front panel 20. Alternately, panel 54 can be pivoted back against panel 42 before closing, if desired.

It will also be understood that appropriate storage areas 95 are provided adjacent either edge of panel assembly 40 inside cabinets 10 or 90 as shown in FIG. 6. Storage areas 95 may be used to house toilet articles, spare light bulbs 74 or the like and are accessible when cover 14 is raised by reaching under top panel 24 on either side.

To assist in closing cover 14, or to prevent the cover from unexpectedly falling, embodiments 10 and 90 of the cabinet may include a gas and spring loaded damping cylinder 120 (FIG. 4) which slows the rate of closing of cover 14. Cylinder 120 is designed for mounting between rear panel 32 and the undersurface of cover 14 adjacent one side edge of the cover and slows the closure over the entire path of travel of cover 14. Cylinder 120 thus serves to dampen and decelerate the closure of cover 14. A suitable cylinder 120 may be obtained from Suspa of Altdorf, West Germany under model designation "Type 16".

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiements of the invention in which an exclusive property or privilege is claimed are as follows:

1. A vanity cabinet comprising:

a bottom panel;

an upstanding rear panel support at the rear of said bottom panel;

a cover panel having an undersurface and front and rear portions;

a front support for said cover panel at the front of said bottom panel;

cover mounting means for pivotally mounting said cover panel to said rear panel for movement between raised and lowered positions in overlying relationship to said bottom panel;

a mirror;

a mirror panel means for supporting said mirror;

mirror mounting means for pivotally supporting said mirror and mirror panel means on the undersurface of said cover panel at a first position adjacent said front of said cover panel;

mirror hinge means for pivotally supporting said mirror and mirror panel means on said mirror mounting means to move said mirror and mirror panel means to different angular positions with respect to said mirror mounting means; said mirror mounting means including adjustment means for positioning and retaining said mirror and mirror panel means in essentially the same selected angular position with respect to said mirror mounting means unless reset regardless of whether said cover panel is raised or lowered;

a rigid support mounted in a fixed position on and extending outwardly from said mirror mounting means at a second position spaced from said first position for supporting said mirror mounting means above said bottom panel when said cover is lowered and in an upright position when said cover panel is raised, said rigid support extending downwardly toward said bottom panel when said cover panel is lowered and extending along and over said bottom panel when said cover panel is raised, said rigid support having a length sufficient to space said mirror, mirror panel means and mirror mounting means above said bottom panel a distance sufficient to allow said mirror and mirror panel means to remain in said selected angular position whether said cover panel is raised or lowered;

bearing means mounted on said rigid support for engaging and movably supporting said mirror mounting means on and along said bottom panel between said rear panel and front support, said bearing means engaging said front support when said cover panel is raised to support said cover panel and said mirror mounting means in said upright position when said cover panel is raised;

whereby when said cover panel is pivoted upwardly, said mirror, mirror panel means, mirror mounting means and rigid support will automatically pivot downwardly and outwardly away from said cover panel on said bearing means to position said mirror for unobstructed closeup viewing.

2. The vanity cabinet of claim 1 wherein said mirror mounting means includes a vanity panel and panel hinge means for pivotally mounting said vanity panel at said first position on said undersurface of said cover panel; said rigid support, mirror panel means and said mirror being mounted on said vanity panel.

3. The vanity cabinet of claim 2 wherein said mirror panel means is a mirror panel; said mirror hinge means pivotally mounting said mirror panel on said vanity panel; said mirror being mounted on said mirror panel.

4. The vanity cabinet of claim 3 wherein said mirror hinge means are mounted adjacent said panel hinge means; said adjustment means including a slotted bracket mounted on said vanity panel and clamping means on said mirror panel for engaging said bracket at various positions to secure said mirror panel in a desired angular position with respect to said vanity panel.

5. The vanity cabinet of claim 2 wherein said vanity panel includes lighting means on said vanity panel adjacent said mirror for illuminating objects or persons to be viewed in said mirror.

6. The vanity cabinet of claim 5 wherein said lighting means include a pair of spaced light panels, each light panel extending along a side of said mirror; and switch means for controlling operation of said light panels.

7. The panel assembly of claim 6 wherein at least one of said light panels includes alight source which projects beyond the front viewing surface of said mirror even when said mirror is held in a selected angular position by said adjustment means.

8. The vanity cabinet of claim 6 wherein each light panel includes a source of light adjacent both the top and bottom of said mirror; said switch means including an automatic switch mounted on the surface of said vanity panel closest to said cover panel; wiring means for connecting said switch means to a source of electricity, said wiring means hidden from view from the front of said vanity cabinet.

9. The vanity cabinet of claim 2 wherein said bearing means include at least one roller secured to said rigid support at the end of said vanity panel which is opposite the end of said vanity panel on which said panel hinge means is mounted, said bearing means extending below said vanity panel for engaging said bottom panel.

10. The vanity cabinet of claim 9 wherein said bearing means include a pair of said rollers spaced apart across said vanity panel.

11. The vanity cabinet of claim 2 wherein said vanity panel is L-shaped and includes a back member on which said mirror is mounted; said rigid support including an end flange extending perpendicularly outwardly from one end of said back member, said panel hinge means secured to said back member at a second end opposite said one end; said bearing means mounted on said end flange.

12. The vanity cabinet of claim 2 wherein said front support also includes means for supporting said cover panel in its lowered position in spaced relationship to said bottom panel.

13. The vanity cabinet of claim 1 wherein said front support includes a decorative front panel secured to said bottom panel and having a top edge adapted to engage said undersurface of said cover panel.

14. The vanity cabinet of claim 1 including at least one storage area below said cover panel and adjacent said mirror mounting means at the side of said cabinet.

15. The vanity cabinet of claim 1 including dampening means for dampening the closure of said cover panel.

16. A vanity cabinet comprising:

a bottom panel;

upstanding front and rear panels spaced apart on said bottom panel;

a cover panel having an undersurface and front and rear portions;

cover mounting means for pivotally mounting said cover panel to said rear panel for movement between raised and lowered positions in overlying relationship to said bottom panel, said front panel supporting said cover panel in its lowered position in spaced relationship to said bottom panel;

a vanity panel having a mirror thereon;

first positioning means for automatically pivoting said vanity panel and mirror with respect to said cover panel from a folded, substantially horizontal, lowered position to an upright position in which said mirror may be used for unobstructed closeup viewing when said cover panel is lifted; and second positioning means for selectively positioning said mirror at a predetermined angular position with respect to said vanity panel, said second positioning means retaining said angular position of said mirror generally constant unless purposely reset regardless of whether said cover panel is raised or lowered;

said first positioning means including a first hinge means for pivotally securing said vanity panel on said undersurface of said cover panel adjacent said front of said cover panel and rolling means on said vanity panel for movably supporting said vanity panel on and along said bottom panel, said vanity panel adapted to pivot under said cover panel when lowered;

said second positioning means including a second hinge means for pivotally mounting said mirror with respect to said vanity panel and bracket means for securing said mirror in a selected pivotal position with respect to said vanity panel;

said vanity panel including a flange extending outwardly therefrom at a position spaced from said first hinge means for supporting said vanity panel in a generally vertical position when said cover panel is raised, said flange including said rolling means and at least one support means spaced from said rolling means for engaging said bottom panel and together with said rolling means, forming a two-point support for said vanity panel in said vertical position.

17. The vanity cabinet of claim 16 wherein said vanity panel includes lighting means on said vanity panel adjacent said mirror for illuminating objects or persons to be viewed in said mirror.

18. The vanity cabinet of claim 17 wherein said lighting means include a pair of spaced light panels, each light panel extending along one side of said mirror; and switch means for controlling operation of said light panels.

19. The vanity cabinet of claim 18 including wiring means for connecting said switch means to a source of electricity, said wiring means being hidden from view from the front of said vanity cabinet.

20. The vanity cabinet of claim 16 including at least one storage area below said cover panel and adjacent said vanity panel at the side of said cabinet.

21. The vanity cabinet of claim 16 including dampening means for dampening the closure of said cover panel.

22. The vanity cabinet of claim 18 wherein at least one of said light panels includes a light source which projects beyond the front viewing surface of said mirror even when said mirror is held in a selected angular position by said second positioning means.

* * * * *